United States Patent [19]

Suimon

[11] 4,387,532

[45] Jun. 14, 1983

[54] TOY REMOTE-CONTROL MOTOR BICYCLE

[75] Inventor: Yoshio Suimon, Tokyo, Japan

[73] Assignee: ICD Corporation, Tokyo, Japan

[21] Appl. No.: 244,407

[22] Filed: Mar. 16, 1981

[30] Foreign Application Priority Data

Nov. 26, 1980 [JP] Japan ..... 55-168388[U]

[51] Int. Cl.[3] ..... A63H 17/16; A63H 30/00

[52] U.S. Cl. ..... 46/254; 46/201

[58] Field of Search ..... 46/201, 202, 206, 211, 46/213, 251, 254, 256, 262; 180/222, 223, 224; 280/179

[56] References Cited

U.S. PATENT DOCUMENTS

| | | | |
|---|---|---|---|
| 3,546,814 | 2/1969 | Melendez | 46/254 |
| 3,708,913 | 1/1973 | Terzian et al. | 46/202 |
| 3,785,086 | 1/1974 | Escobedo | 46/213 |
| 3,826,038 | 7/1974 | Gentilini | 46/202 |
| 4,267,663 | 5/1981 | Nagahara | 46/254 |

FOREIGN PATENT DOCUMENTS

| | | | |
|---|---|---|---|
| 1098676 | 3/1955 | France | 46/213 |
| 1229755 | 3/1960 | France | 46/213 |

*Primary Examiner*—F. Barry Shay

*Attorney, Agent, or Firm*—Flynn, Thiel, Boutell & Tanis

[57] ABSTRACT

A toy remote-control motor bicycle comprising a servomotor for steering control of the front wheel provided on a chassis, a steering arm provided between the front wheel and the servomotor, which is characterized in that the rear end portion of the steering arm is made freely rotatable by the servomotor either to a clockwise direction or a counterclockwise direction while the front end portion thereof is made freely rotatable to assume the same direction, thereby displacing in parallel the front wheel to a position deviated from the central line of the chassis and moving the center of gravity of the chassis so as to steer the front wheel either to a clockwise direction or a counterclockwise direction readily.

6 Claims, 7 Drawing Figures

TOY REMOTE-CONTROL MOTOR BICYCLE

This invention relates to a remote-control motor bicycle and, more particularly, to a toy remote-control motor bicycle having an improved steering mechanism.

In the prior art a remote-controlled motor bicycle of this type is controlled either by a motor which is incorporated in the chassis and the rotation of the output the shaft of which is transmitted to a member supporting the front wheel via a gear for making the bicycle move straight ahead or turn either left or right, or by a servomotor which is incorporated in the chassis and the output shaft of which is transmitted to a member supporting a front wheel for directional control similar to the above.

Generally, the former motor or a directional switch control means using a gear is used for low-priced toys, whilst the latter or a directional switch control means using a servomotor is used for high-priced toys. The toy remote-control motor bicycle using the servomotor or a directional switch control means using a servo-motor, however, has a drawback that the structure of the steering control mechanism tends to be extremely complicated with a large number of parts, thus, pushing up the cost of the final product.

The present invention was conceived to obviate such drawbacks of a toy remote-control motor bicycle having a steering control mechanism with a servomotor, and aims at providing a toy remote-control motor bicycle with much simpler structure and yet with almost the same or even superior functions compared with the prior art.

Figure 1:
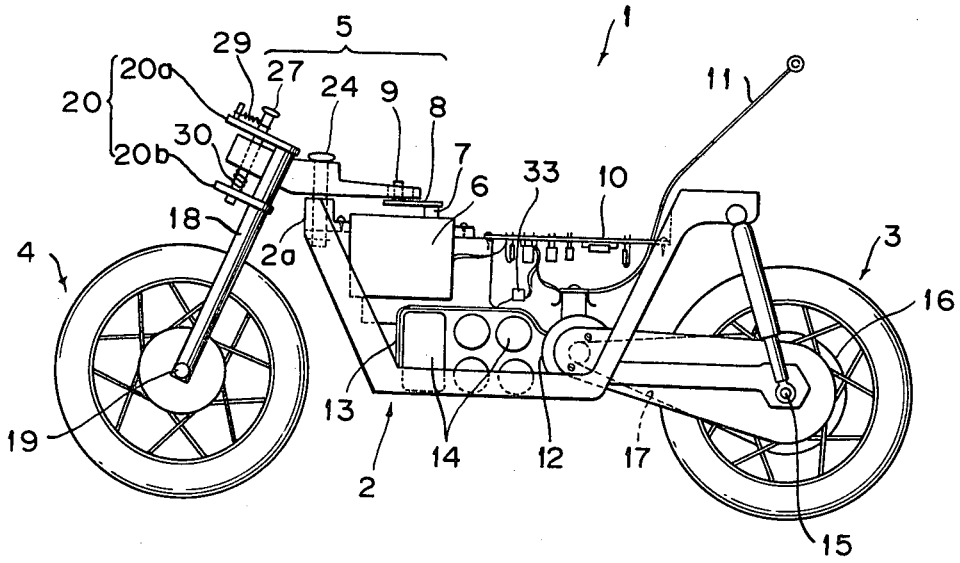
Figure 2:
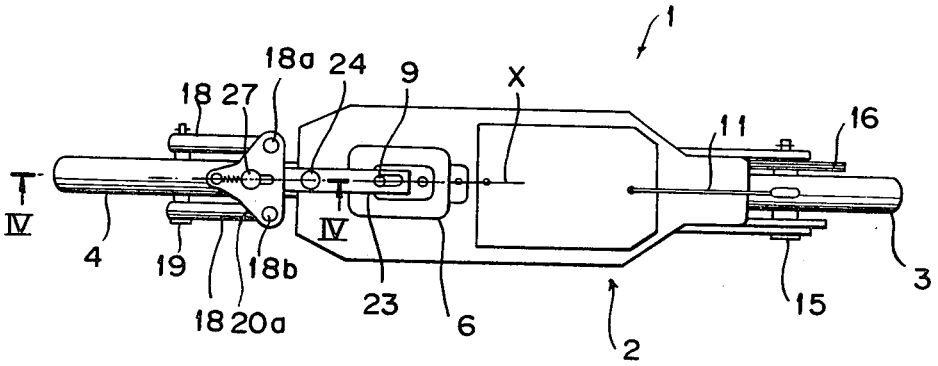
Figure 3:
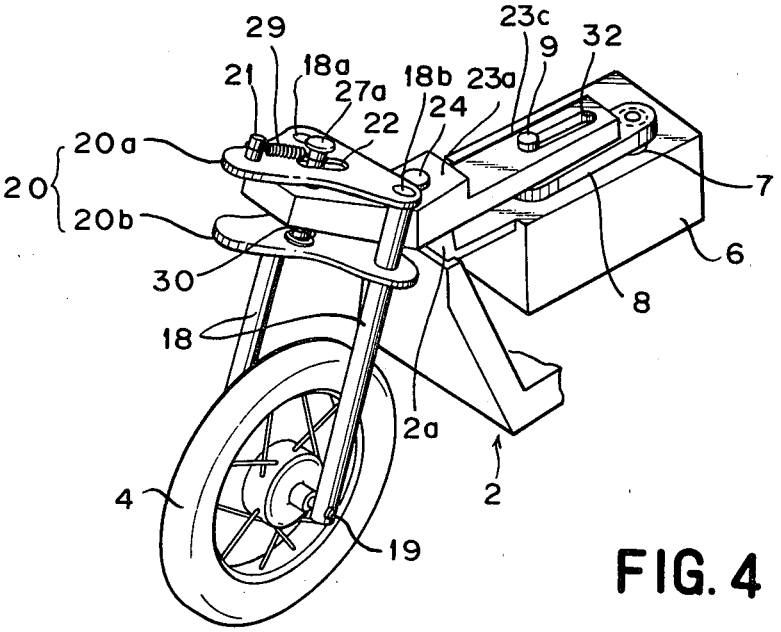
Figure 4:
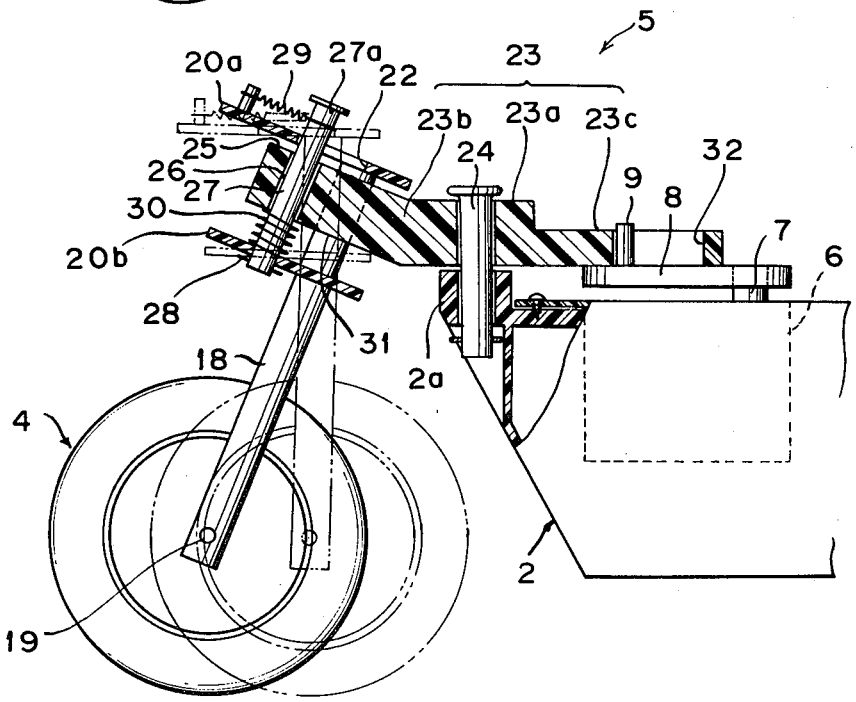
Figure 5:
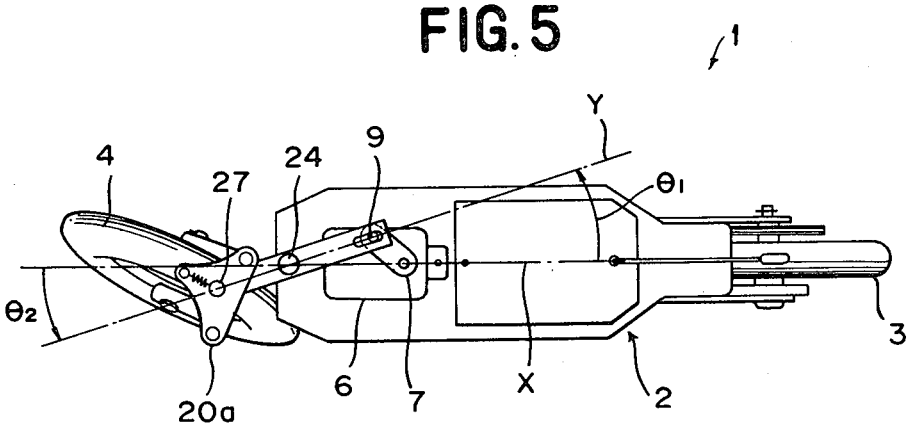
Figure 6:
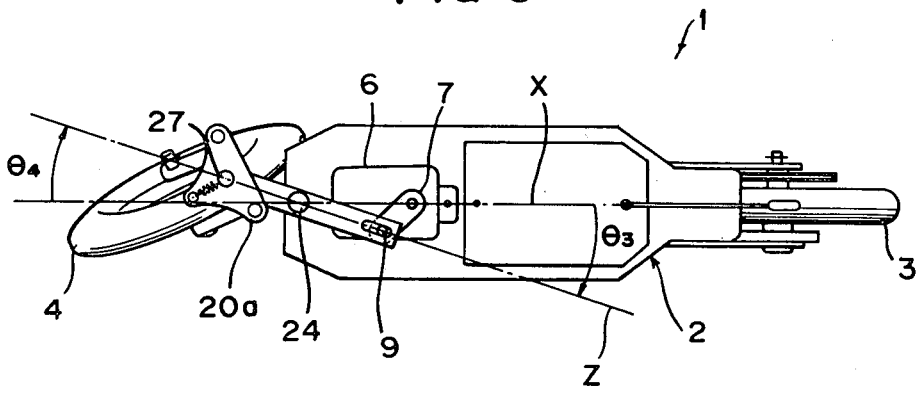
Figure 7:
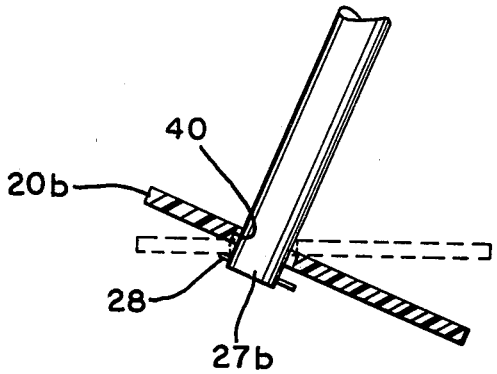

Other objects and advantageous features of the present invention will be readily understood from the detailed description given hereinafter and the attached drawings of a preferred embodiment. In the attached drawings, FIG. 1 is a schematic side view of a toy remote-control motor bicycle;

FIG. 2 is the plan view thereof,

FIG. 3 is a partially exploded perspective view to specifically illustrate the steering mechanism and the front wheel support mechanism thereof, FIG. 4 is an enlarged cross sectional view along the line IV—IV of FIG. 2, FIG. 5 is a plan view illustrating a condition when the front wheel is controlled to turn to the right and, FIG. 6 is a plan view illustrating a condition when the front wheel is controlled to turn to the left; and FIG. 7 is an enlarged view of a fragment of FIG. 4.

The present invention will now be explained in detail with reference to the attached drawings. The toy remote-control motor bicycle 1 according to the present invention mainly comprises a chassis 2, a rear wheel 3, a front wheel 4 and a steering mechanism 5.

A servomotor 6 is mounted on the chassis 2 for switching the direction of advance, i.e. movement straight ahead, turn to the right or turn to the left. The reference numeral 7 denotes an arcuately movable shaft to which one end of a horizontally arcuately movable arm 8 is fixed. A pin 9 projects upwardly from the other end of the horizontally arcuately movable arm 8.

The servomotor 6 is provided with a printed circuit board 10 which comprises the control circuit therefor. The reference numeral 11 denotes a receiver antenna which is connected to the printed circuit board 10, while 33 denotes a handling switch. The receiver antenna 11 receives signals from the remote-control transmitter (not shown) and transmits them to the servomotor 6 to make the arcuately movable shaft 7 and the horizontally arcuately movable arm 8 turn either to the right or the left. When no signals are transmitted from said remote-control transmitter (not shown), the servomotor 6 is constructed so that the shaft 7 and the arm 8 are returned to their straight-ahead position or neutral position from either the left turn position or the right turn position.

The reference numeral 12 denotes a motor for driving the rear wheel 3 which is mounted in the chassis. In the chassis 2 there is provided a battery box 13 in which batteries 14 are housed as the power source for the servomotor 6 and the motor 12. In the drawings, a saddle and a carrier seat are omitted frm the illustration but they may be formed integrally with the cover to be placed over the chassis 2, and may be made of materials such as plastics.

The rear wheel 3 is journalled in a freely rotatable manner on the rear portion of the chassis 2 is a pin 15. A drive wheel 16 is provided integral with the rear wheel 3, the drive wheel 16 being connected to the output shaft of the motor 12 through a rubber belt 17.

The front wheel 4 is journalled to a front steering fork comprising pair of rods 18 in a manner freely rotatable on an axle 19 located at the lower ends of the front fork rods 18. So the upper ends of the rods 18 is fixed a support 20 comprising a pair of support plates **20*a* and 20*b* which are arranged in parallel to each other. The steering wheel is omitted from the illustration. The upper support plate 20*a* and the lower support plate 20*b* are substantially triangular in shape and are conected to the upper end portions 18*a*, 18*b*, of the rods 18 at positions close to the two rear corners of said plates (the upper and the lower corners as shown in FIG. 2). A pin projects upwardly from the upper support plate 20*a* at a location close to the apex of the upper support plate 20*a*. The reference numeral 22 denotes an elongated hole which is located at the center of the upper support plate 20*a* and extends in the longitudinal direction thereof. The length of the elongated hole 22 is sufficient to permit the front wheel 4 to move between the solid line position thereof and the phantom line position thereof in FIG.4**.

The steering mechanism 5 comprisea directional steering arm 23 and accessory parts thereof. The directional steering arm 23 is journalled in a freely rotatable fashion at the central portion thereof **23*a* to the upper face of the end portion 2*a* of the chassis 2 via the first support shaft 24. The front end portion 23*b* of the direction steering arm 23 is upwardly inclined in the frontward direction and is provided with a through-hole 26 in a direction perpendicular to the inclined face 25 as shown on an enlarged scale in FIG. 4. The second support shaft 27 extends through the through-hole 26 and also extends through the support plates 20*a* and 20*b*. The 20*b* are thereby journalled in a freely rotatable fashion to the front end portion 23*b* via said second supporting shaft 27. Referring now to FIG. 3, the front end portion 23*b* of the directional steering arm 23 extends between the upper and the lower support plates 20*a* and 20*b* and between the upper portions 18*a* and 18*b* of the fork rods 18. The second support shaft 27 extends through the slot 22 in the upper support plate 20*a*, through the through-hole or bore 26 in the front end portion 23*b* of the steering arm 23 and thence downward to beneath the through a hole 40 downwardly to a position lower supporting plate 20b. The lower end 27b of the second supporting shaft 27 is fixed against removal from the lower supporting plate 20b by a retainer ring 28. The through-hole 40, which is provided approximately at the midpoint of the lower plate 20b, has a diameter larger than that of the support shaft 27, as shown in FIG. 7. Thus, the support plate 20b can move between the solid line position and phantom line position thereof, as shown in FIG. 4. The upper end portion 27a of the second shaft 27 projects above the upper supporting plate 20a. One end of a first tension spring 29 is connected to the pin 21 projecting above the upper support plate 20a, while the other end thereof is connected to the upper end 27a of the second supporting shaft 27. The first spring 29 is used to maintain stability of the supporting plate 20 with respect of the front end portion 23b of the directional steering arm 23**.

The second supporting shaf t 27 is further provided with a second spring 30, which is in compression whereby to absorb shock. More specifically, the second spring 30 is provided in the space between the lower face 31 of the front end 23b of the directional steering arm 23 and the upper face of the lower support plate 20b to absorb vibration or shock which might be transmitted from the front wheel 4 to the fork rods 18 and the lower support plate 20b.

The rear portion 23c of the directional steering arm 23 has an elongated hole 32 in the longitudinal direction thereof. The pin 9 projecting at the end of said horizontally rotating arm 8 is received within the elongated hole 32.

The operation of the toy remote-control motor bicycle will be explained hereinafter. When the motor bicycle is to advance straight ahead, the shaft 7 of the servomotor 6 and the arm 8 are set at the neutral positions and the positions of the pin 9 and the second supporting shaft 27 with respect to the first supporting shaft 24 lie along the straight line marked with the letter X in FIG. 2. When the direction of movement of the bicycle is to be changed to the right, a corresponding a signal is transmitted from a remote-control transmitter (not shown and), is received by the receiver antenna 11 which a gives a driving signal to servomotor 6 through the printed circuit board 10. The shaft 7 of the servomotor 6 is made to move through a clockwise to make the arm 8 also move clockwise similarly so that the pin 9 is moved within the elongated hole 32, thereby the directional steering arm 23 counterclockwise around the first supporting shaft 24. Referring to FIG. 5, the revolving angle $\theta_1$ of displacement of the directional steering arm 23 is equivalent to the stroke required to move the pin 9 from the one end to the other end of the elongated hole 32. Accordingly the front end 23b of the directional steering arm 23 is made to move through the angle $\theta_2[\theta_1=\theta_2]$.

Simultaneously the supporting plates 20, the front rod 18 and the front wheel 4 are moved clockwise through the angle $\theta_2$ (as shown in FIG. 5) through the second supporting shaft 27. Under such conditions, the straight line Y on which the pin 9, the first supporting shaft 24 and the second supporting shaft 27 are located is at a position rotated through the angle $\theta_2[\theta_1=\theta_2]$ from the central line X of the chassis 2, whereby the center of gravity of the chassis is displaced below the central line X as appearing in FIG. 5, thus inclining the whole body of the toy remote-control motor bicycle 1 in the direction shown in FIG. 5. This makes the front wheel 4, the front rods 18 and the supporting plates 20 rotate clockwise around the second supporting shaft 27 in order to correct the condition made by the displacement by the angle $\theta_2$. Therefore, the whole body of the motor bicycle 1 is directed to advance towards the right as shown in FIG. 5.

When the direction of advance has been changed a signal is given to the servomotor 6 to restore the straight-ahead direction by rotating the one described above so that the directional steering arm 23 is rotated around the first supporting shaft 24 by means of counterclockwise rotation of the pin 9 to position the pin 9, the first supporting shaft 24 and the second supporting shaft 27 on the central line X of the chassis 2. Accordingly, the front wheel 4 is returned to the advance-ahead position so that the motor bicycle 1 proceeds straight ahead. If a signal to turn to the right is continuously transmitted from the remote-control transmitter (not shown), the front wheel 4 maintains the state shown in FIG. 5 without restoring the previous straight-ahead state, making the motor bicycle 1 run on a predetermined circular track to the right.

When the case motor bicycle 1 is made to turn to the left, or the direction opposite to the above, the positions of the pin 9, the first supporting shaft 24 and the second supporting shaft 27 are brought to the positions on the straight line Z displaced from the central line X of the chassis 2 by the revolution angles $\theta_3$ and $\theta_4[\theta_3=\theta_4]$ through operations opposite to those described above. The front wheel 4 is rotated around the second supporting shaft 27 counterclockwise, driving the whole body of the motor bicycle 1 to the left as shown in FIG. 6. Further detailed explanation will be omitted since the operation of the steering mechanism is substantially similar to the direction in the case described above except that the direction is opposite to the above.

As described in the foregoing, the present invention enables a motor bicycle to be steered without the risk of toppling over by means of a steering mechanism which extremely simple compared to prior art mechanisms and which gives performance equal or superior to conventional complicated steering mechanism. The present invention further provides a toy remote-control motor bicycle constructed with a smaller number of parts and at a lower cost than similar conventional bicycles.

What we claim:

1. In a toy, remote-controlled, motor-driven bicycle including an elongate chassis, a rear wheel rotatably mounted on the rear portion of said chassis, a steerable front wheel rotatably mounted on the front portion of said chassis, a motor for driving said bicycle, power-supply means for operating said motor, remote control means for receiving external signals and controlling the direction of movement of said bicycle in response thereto, a steerable front-wheel support mechanism rotatably supporting said front wheel, means connecting said front-wheel support mechanism to said chassis and adapted for steering said bicycle by effecting steering movement of said front-wheel support mechanism in unison with said front wheel, the improvement which comprises: said front-wheel support mechanism comprises a steering fork having, at its lower end, an axle on which said front wheel is mounted for rotation; an upper support plate and a lower support plate both fixedly mounted on the upper portion of said steering fork in parallel, vertically spaced-apart relation; said means for effecting steering movement of said front-wheel support mechanism comprising a first, directional steering arm extending forwardly from the upper side of said chassis at the front end thereof, a first support shaft supporting said directional steering arm for pivotal movement with respect to said chassis about a vertical axis, the forward end portion of said directional steering arm extending between said upper and lower support plates, a second support shaft connecting the forward end portion of said directional steering arm to said upper and lower support plates so that said upper and lower support plates can pivot with respect to said directional steering arm about the axis of said second support shaft, the rearward end portion of said directional steeringarm extending rearwardly in the lengthwise direction of said chassis and having an elongated guideway therein which guideway is elongated in the lengthwise direction of said chassis, a servomotor mounted on said chassis which servomotor is driven in response to said remote control means, a second arm extending lengthwise of said chassis on the upper side thereof, said second arm having an upwardly projecting pin at the forward end thereof, which pin extends into said elongated guideway in said first, directional steering arm, said servomotor having a drive shaft drivingly connected to the rear end of said second arm for pivotally moving said second arm with respect to said chassis about a vertical axis and thereby causing pivotal movement of said directional steering arm about the axis of said first support shaft, said drive shaft being reversibly rotatable by means of said servomotor.

2. A toy, remote-controlled, motor-driven bicycle according to claim 1, wherein said first directional steering arm is journalled on said first support shaft approximately midway between the front and rear ends of said directional steering arm.

3. A toy, remote-controlled, motor-driven bicycle according to claim 1, wherein the forward end portion of said first directional steering arm is inclined upwardly in a direction forwardly of said chassis and has a hole which extends perpendicularly therethrough, said second support shaft extending through said hole.

4. A toy, remote-controlled, motor-driven bicycle according to claim 1, wherein said second support shaft projects upwardly through a first hole in said upper support plate which first hole is elongated in the direction of said chassis, said second support shaft having an upper portion projecting above the upper surface of said upper support plate, said upper support plate has a pin projecting upwardly from its upper surface and located in front of the forward end of said first hole, further including a first tension spring connected between said pin and said upper portion of said second support shaft for resiliently yieldably continuously urging said upper portion of said second support shaft to the forward end of said first hole, said lower support plate having a second hole which slidably receives the lower end of said second support shaft so that said second support shaft can pivot forwardly and rearwardly with respect to said lower support plate.

5. A toy, remote-controlled, motor-driven bicycle as claimed in claim 4, including a second compression spring mounted in association with said second support shaft between the lower surface of the forward end portion of said first directional steering arm and the upper surface of said lower support plate for resiliently yieldably urging said lower support plate downwardly relative to said first directional steering arm.

6. A toy, remote-controlled, motor-driven bicycle as claimed in claim 4, in which said forward end portion of said first directional steering arm is inclined upwardly in a direction forwardly of said chassis, said steering fork comprises two upright parallel posts which are fixed to and extend perpendicularly to said upper and lower support plates, said second support shaft extends perpendicular to the forward end portion of said first directional steering arm, said posts and said upper and lower support plates being mounted for joint, reversible, pivotal movement with respect to said forward end portion of said first directional steering arm between an inclined first position in which said upper and lower support plates extend substantially parallel with said forward end portion of said first directional steering arm and the upper portion of said second support shaft is located at the forward end of said first hole, and a second position in which said upper and lower support plates extend substantially horizontally and the upper portion of said second support shaft is located at the rearward end of said elongated first hole.

* * * * *